US008668326B2

(12) United States Patent
Burress

(10) Patent No.: US 8,668,326 B2
(45) Date of Patent: Mar. 11, 2014

(54) DRUM MAINTENANCE SYSTEM WITH LEAK DETECTION

(75) Inventor: Edward Francis Burress, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 425 days.

(21) Appl. No.: 13/027,315

(22) Filed: Feb. 15, 2011

(65) Prior Publication Data

US 2012/0206516 A1 Aug. 16, 2012

(51) Int. Cl.
*B41J 2/01* (2006.01)

(52) U.S. Cl.
USPC ..... 347/103

(58) Field of Classification Search
CPC ..... B41J 2/0057; B41J 2/17593
USPC ..... 347/9, 19, 22, 28, 29, 88, 99, 103
See application file for complete search history.

(56) References Cited

U.S. PATENT DOCUMENTS

| | | | | |
|---|---|---|---|---|
| 5,661,405 | A | 8/1997 | Simon et al. | |
| 6,792,967 | B1 | 9/2004 | Franklin | |
| 6,801,420 | B2 | 10/2004 | Talbot et al. | |
| 6,899,122 | B1 | 5/2005 | Mele | |
| 7,082,959 | B1 | 8/2006 | Franklin | |
| 7,677,717 | B2 * | 3/2010 | Islam et al. | 347/103 |

* cited by examiner

*Primary Examiner* — An Do
(74) *Attorney, Agent, or Firm* — Maginot, Moore & Beck, LLP

(57) ABSTRACT

A printer includes a release agent detector that responds to release agent contacting the detector by generating a signal. The signal is processed by a controller to alter operation of the printer.

29 Claims, 7 Drawing Sheets

DRUM MAINTENANCE SYSTEM WITH LEAK DETECTION

TECHNICAL FIELD

The apparatus and method described below relates to phase change inkjet printers, and more particularly to release agent application systems used in these printers.

BACKGROUND

Phase change inkjet printers typically receive phase change ink in a solid form. Blocks or ingots of solid ink are commonly referred to as ink sticks. Solid ink sticks are loaded into a printer and then melted to produce liquid, molten ink that is used to form images on print media. Phase change inkjet printers form images using either a direct or an offset (or indirect) print process. In a direct print process, molten ink is jetted directly onto print media to form images. In an offset print process, molten ink is jetted onto a transfer surface, such as the surface of a rotating drum, belt, or band. Print media are moved proximate the surface of the rotating drum in synchronization with the ink images formed on the surface. The print media are then pressed against the surface on top of the ink images to transfer and affix the ink to the print media.

Phase change inkjet printers are typically equipped with a drum maintenance system for applying release agent to the surface of the rotating member. The release agent is an oil, such as silicone oil or a similar type of substance. The drum maintenance system includes a reservoir that holds a supply of the release agent and a release agent applicator, such as a foam roller, configured to transfer the release agent from the reservoir to the surface of the drum. The release agent is applied to the surface of the drum to form a layer that receives the molten ink emitted by the inkjets. The layer of release agent facilitates the transfer of the ink image from the drum to media and helps prevent the adherence of ink to the drum surface during printing operations. Drum maintenance systems may be provided as customer replaceable units to facilitate the removal and replacement of the unit when the release agent in the reservoir is depleted.

Positioning any fluid containing structure, such as a reservoir of release agent, within the housing of a printer poses the risk of fluid leakage and spills onto the interior components of the printer. Due to the nature of the release agent fluid and the environment in which it is used, previously known leak sensors and detection systems are generally not suitable for use with drum maintenance systems of phase change inkjet printers. For example, some leak detection systems rely on the conductivity of leaked fluid to provide an indication of a leak condition. These sensors and systems are generally not capable of detecting or indicating leakage of a non-conductive fluid, such as release agent. Other types of leak detections systems utilize resistive sensing methods, float assemblies, or other methods that may be impractical to implement in customer replaceable drum maintenance systems due to complexity and/or cost.

SUMMARY

In one embodiment, a printer comprises a rotatable member having an image receiving surface, and a printing system configured to deposit ink onto the surface of the rotatable member. A release agent supply includes an applicator that is configured for selective engagement with the rotating image receiving member to transfer release agent from the release agent supply to the rotating image receiving member. A release agent detector is positioned proximate the release agent supply. The release agent detector includes an electrical conductor and a substrate. The substrate responds to contact with release agent to alter electrical continuity of the electrical conductor. An electrical power supply is operatively connected to the electrical conductor of the release agent detector. A controller is operatively connected to the electrical conductor of the release agent to monitor electrical current in the electrical conductor of the release agent detector and to detect a change in the electrical continuity of the electrical conductor occurring in response to the substrate contacting release agent.

In another embodiment, a drum maintenance unit for an inkjet printer comprises a housing configured for insertion into and removal from an inkjet printer proximate a rotatable image receiving member in the inkjet printer. The housing includes a reservoir. A supply of release agent is contained within the reservoir. An applicator is supported by the housing, the applicator being configured for selective engagement with the rotatable member to transfer release agent from the release agent supply to the rotatable member. A release agent detector is secured to the housing proximate the release agent supply. The release agent detector includes an electrical conductor and a substrate. The substrate responds to contact with release agent to alter electrical continuity of the electrical conductor. An electrical connector is configured to electrically couple the conductor of the release agent detector to a power supply when the housing is inserted into the solid ink printer.

In yet another embodiment, a method of servicing an inkjet printer comprises removing a first drum maintenance unit from an inkjet printer, the first drum maintenance unit including a reservoir for containing a supply of release agent, an applicator for transferring release agent from the reservoir to a surface of a rotatable image receiving member of the inkjet printer, and a first release agent detector including a first electrical conductor having a first electrical continuity; and installing a second drum maintenance unit in the inkjet printer, the second drum maintenance unit including a reservoir for containing a supply of release agent, an applicator for transferring release agent from the reservoir to the surface of the rotatable image receiving member, and a second release agent detector having a second electrical conductor and a substrate, the second electrical conductor having a second electrical continuity, the substrate being comprised of a material that changes in response to contact with release agent. The second electrical conductor and the substrate are configured in the second drum maintenance unit to enable the second electrical conductor to change from the second electrical continuity to the first electrical continuity in response to the substrate contacting release agent.

In another embodiment, a method of servicing a drum maintenance unit comprises removing a first release agent detector from a housing of a drum maintenance unit, the housing including a reservoir for containing a supply of release agent and an applicator for transferring release agent from the reservoir to a rotatable image receiving surface of an inkjet printer, the first release agent detector having a first electrical conductor, the first electrical conductor having a first electrical continuity; and incorporating a second release agent detector into the housing of the drum maintenance unit, the second release agent detector having a second electrical conductor and a substrate, the second electrical conductor having a second electrical continuity, the second being comprised of a material that alters the electrical continuity of the second electrical conductor from the second electrical continuity to the first electrical continuity in response to contact with release agent.

DETAILED DESCRIPTION

Figure 1:
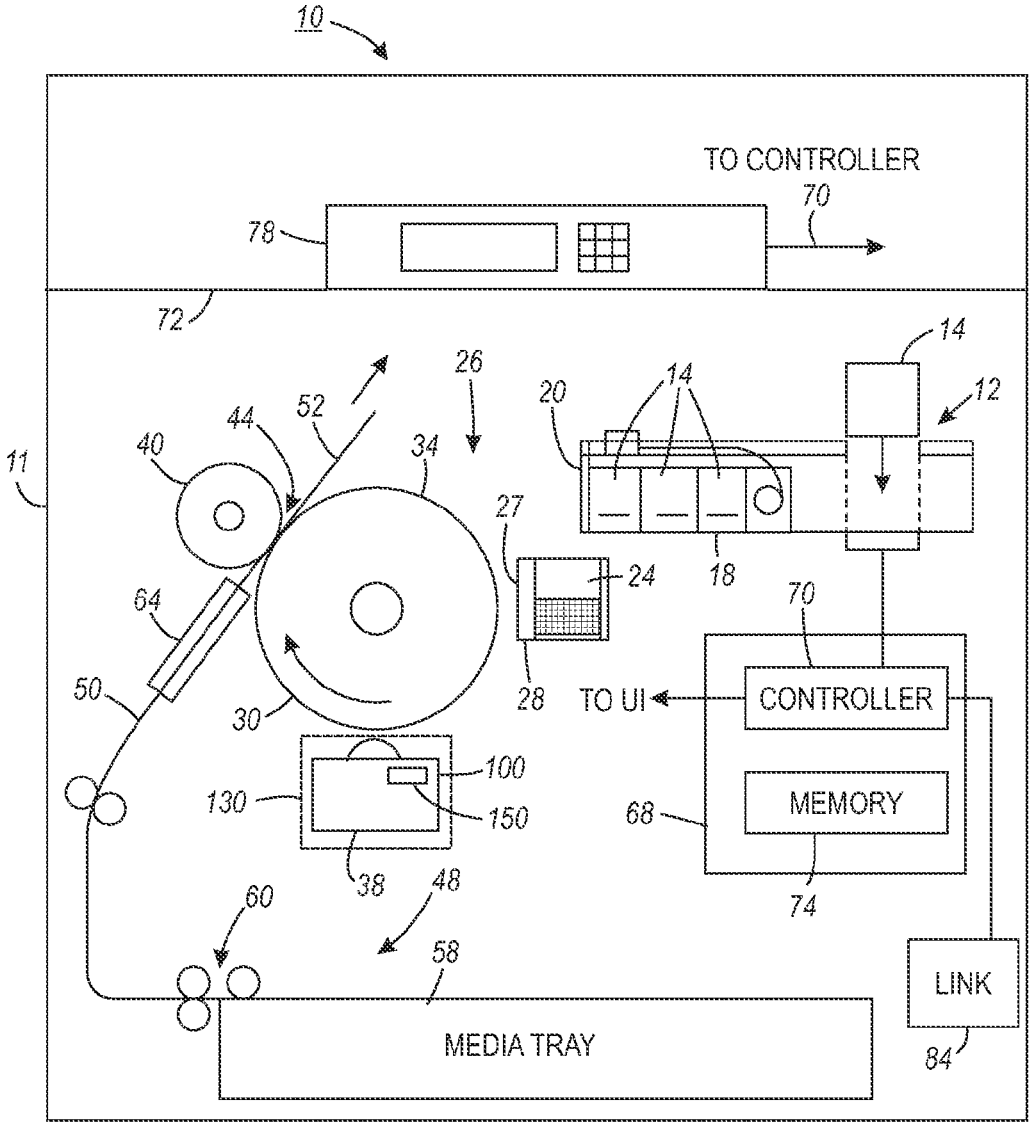
FIG. 1 is a schematic view of an indirect phase change inkjet printing system.

The description below and the accompanying figures provide a general understanding of the environment for the system and method disclosed herein as well as the details for the system and method. In the drawings, like reference numerals are used throughout to designate like elements. The word "printer" as used herein encompasses any apparatus that generates an image on media with ink. The word "printer" includes, but is not limited to, a digital copier, a bookmaking machine, a facsimile machine, a multi-function machine, or the like.

FIG. 1 is a side schematic view of a phase change inkjet printing device 10 that includes a drum maintenance unit (DMU) 100 equipped with a release agent detection system 150. The DMU 100 is configured to selectively apply release agent to a surface of a rotatable or movable member in the device 10 that receives and/or bears image marking material, such as melted phase change ink. As discussed below, the release agent detection system 150 comprises an electrical conductor supported by a substrate. The electrical conductor is configured to operatively connect to an electric power supply in the device 10. The substrate is formed of a material or combination of materials that exhibits a physical reaction, such as changing size, changing shape, and/or by dissolving, in response to contact with release agent fluid. The electrical conductor is supported by the substrate in a manner that enables the physical reaction of the substrate to be used to alter the electrical continuity of the conductor. Release agent leaks may therefore be detected by monitoring the electric current in the conductor to detect changes in continuity indicative of the substrate contacting release agent. In response to detection of a release agent leak, the control system 68 of the device 10 may take appropriate action, such as initiating an alarm, reporting an error condition, disabling the DMU, and/or disabling print operations.

Although a phase change inkjet system is shown and described herein, a release agent detection system in accordance with this disclosure may be utilized with other drum maintenance systems and release agent application systems for in other systems that utilize an image receiving, bearing, or contacting member to transfer image material to a print sheet, such as a fuser roll in a xerographic printer. The release agent detection system may also be employed to detect leaks, spills, mishandling, and misrouting of fluids or chemicals for applications other than the release drum maintenance systems in printers. Examples of applications and fluids that may benefit from the use of a leak detection system in accordance with the present disclosure include, but are not limited to, print head maintenance fluids in printers, aqueous based inks, fuel delivery systems, chemical processing plants, waste treatment plants, dry storage facilities, and the like.

FIG. 1 depicts the relationship between the DMU 100 and the other components of the exemplary phase change inkjet printing device 10. The device 10 includes a housing 11 that supports and at least partially encloses an ink loader 12, a printing system 26, a media supply and handling system 48, and a control system 68. The ink loader 12 receives and delivers solid ink to a melting device for generation of liquid ink. The printing system includes a plurality of inkjet ejectors that is fluidly connected to receive the melted ink from the melting device. The inkjet ejectors emit drops of liquid ink onto an image receiving surface under the control of system 68. The media supply and handling system 48 extracts media from one or more supplies in the printer 10, synchronizes delivery of the media to a transfix nip for the transfer of an ink image from the image receiving surface to the media, and then delivers the printed media to an output area.

In more detail, the ink loader 12 is configured to receive phase change ink in solid form, such as blocks of ink 14, which are commonly called ink sticks. The ink loader 12 includes feed channels 18 into which ink sticks 14 are inserted. Although a single feed channel 18 is visible in FIG. 1, the ink loader 12 includes a separate feed channel for each color or shade of color of ink stick 14 used in the printer 10. The feed channel 18 guides ink sticks 14 toward a melting assembly 20 at one end of the channel 18 where the sticks are heated to a phase change ink melting temperature to melt the solid ink to form liquid ink. Any suitable melting temperature may be used depending on the phase change ink formulation. In one embodiment, the phase change ink melting temperature is approximately 80° C. to 130° C.

The melted ink from the melting assembly 20 is directed gravitationally or by other means to a melt reservoir 24. A separate melt reservoir 24 may be provided for each ink color, shade, or composition used in the printer 10. Alternatively, a single reservoir housing may be compartmentalized to contain the differently colored inks. As depicted in FIG. 1, the ink reservoir 24 comprises a printhead reservoir that supplies melted ink to inkjet ejectors 27 formed in the printhead(s) 28. The ink reservoir 24 may be integrated into or intimately associated with the printhead 28. In alternative embodiments, the reservoir 24 may be a separate or independent unit from the printhead 28. Each melt reservoir 24 may include a heating element operable to heat the ink contained in the corresponding reservoir to a temperature suitable for melting the ink and/or maintaining the ink in liquid or molten form, at least during appropriate operational states of the printer 10.

The printing system 26 includes at least one printhead 28. One printhead 28 is shown in FIG. 1 although any suitable number of printheads 28 may be used. The printhead 28 is operated in accordance with firing signals generated by the control system 68 to eject drops of ink toward an ink receiving surface. The device 10 of FIG. 1 is an indirect printer configured to use an indirect printing process in which the drops of ink are ejected onto an intermediate surface 30 and then transferred to print media. In alternative embodiments, the device 10 may be configured to eject the drops of ink directly onto print media.

The rotating member 34 is shown as a drum in FIG. 1 although in alternative embodiments the rotating member 34 may comprise a moving or rotating belt, band, roller or other similar type of structure. A transfix roller 40 is loaded against the intermediate surface 30 on rotating member 34 to form a nip 44 through which sheets of print media 52 pass. The sheets are fed through the nip 44 in timed registration with an ink image formed on the intermediate surface 30 by the inkjets of the printhead 28. Pressure (and in some cases heat) is generated in the nip 44 to facilitate the transfer of the ink drops from the surface 30 to the print media 52 while substantially preventing the ink from adhering to the rotating member 34.

The media supply and handling system 48 of printer 10 transports print media along a media path 50 that passes through the nip 44. The media supply and handling system 48 includes at least one print media source 58, such as supply tray 58. The media supply and handling system also includes suitable mechanisms, such as rollers 60, which may be driven or idle rollers, as well as baffles, deflectors, and the like, for transporting media along the media path 50.

Media conditioning devices may be positioned at various points along the media path 50 to thermally prepare the print media to receive melted phase change ink. In the embodiment of FIG. 1, a preheating assembly 64 is utilized to bring print media on media path 50 to an initial predetermined temperature prior to reaching the nip 44. Media conditioning devices, such as the preheating assembly 64, may rely on radiant, conductive, or convective heat or any combination of these heat forms to bring the media to a target preheat temperature, which in one practical embodiment, is in a range of about 30° C. to about 70° C. In alternative embodiments, other thermal conditioning devices may be used along the media path before, during, and after ink has been deposited onto the media.

A control system 68 aids in operation and control of the various subsystems, components, and functions of the printer 10. The control system 68 is operatively connected to one or more image sources 72, such as a scanner system or a work station connection, to receive and manage image data from the sources and to generate control signals that are delivered to the components and subsystems of the printer. Some of the control signals are based on the image data, such as the firing signals, and these firing signals operate the printheads as noted above. Other control signals cause the components and subsystems of the printer to perform various procedures and operations for preparing the intermediate surface 30, delivering media to the transfix nip, and transferring ink images onto the media output by the imaging device 10.

The control system 68 includes a controller 70, electronic storage or memory 74, and a user interface (UI) 78. The controller 70 comprises a processing device, such as a central processing unit (CPU), an application specific integrated circuit (ASIC), a field programmable gate array (FPGA) device, or a microcontroller. Among other tasks, the processing device processes images provided by the image sources 72. The one or more processing devices comprising the controller 70 are configured with programmed instructions that are stored in the memory 74. The controller 70 executes these instructions to operate the components and subsystems of the printer. Any suitable type of memory or electronic storage may be used. For example, the memory 74 may be a non-volatile memory, such as read only memory (ROM), or a programmable non-volatile memory, such as EEPROM or flash memory.

User interface (UI) 78 comprises a suitable input/output device located on the imaging device 10 that enables operator interaction with the control system 68. For example, UI 78 may include a keypad and display (not shown). The controller 70 is operatively coupled to the user interface 78 to receive signals indicative of selections and other information input to the user interface 78 by a user or operator of the device. Controller 70 is operatively coupled to the user interface 78 to display information to a user or operator including selectable options, machine status, consumable status, and the like. The controller 70 may also be coupled to a communication link 84, such as a computer network, for receiving image data and user interaction data from remote locations.

Figure 2A:
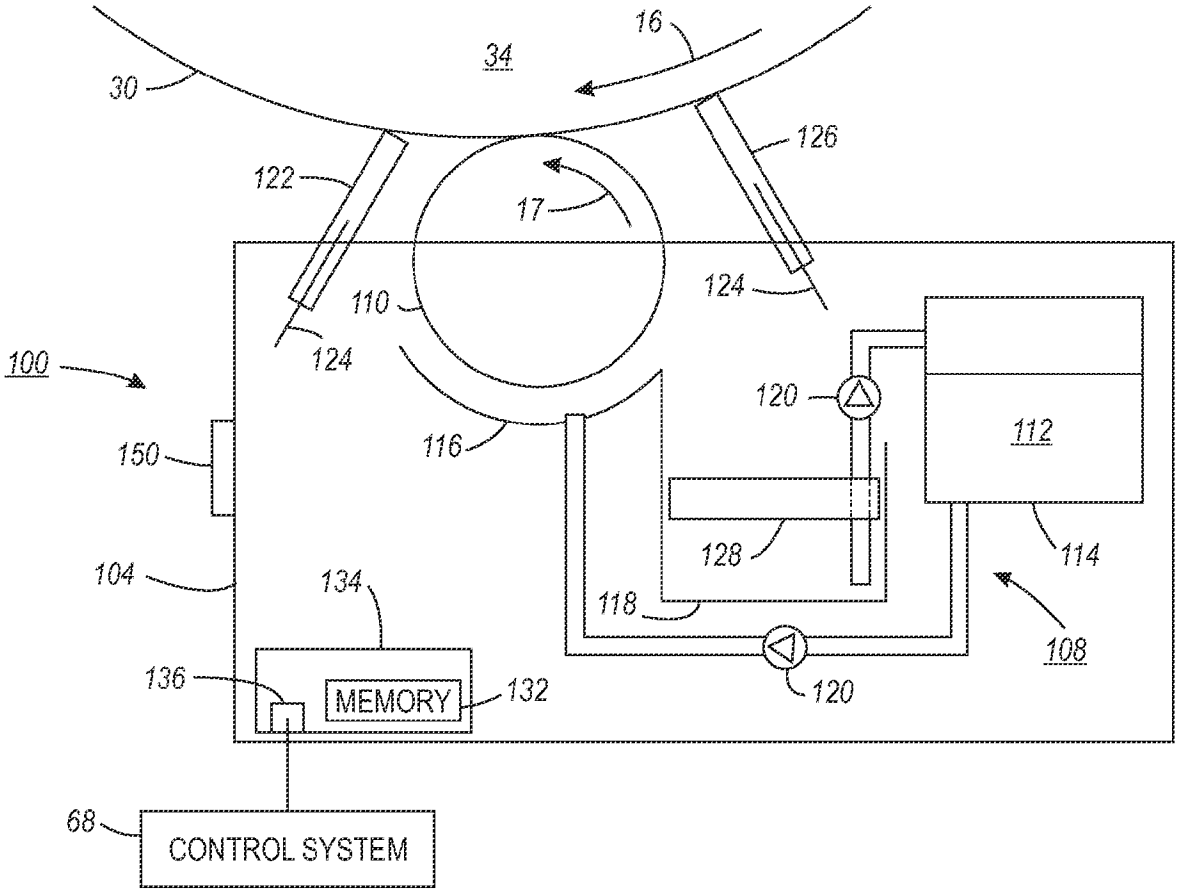
FIG. 2A is a schematic view of drum maintenance system of the printing system of FIG. 1 having a release agent detector.

To facilitate transfer of an ink image from the drum to print media, the device 10 is provided with a drum maintenance unit (DMU) 100 for applying release agent to the surface 30 of the rotating member 34. Referring to FIG. 2A, the DMU 100 includes a housing 104, a reservoir 108 positioned within the housing that is configured to hold a supply of release agent 112, and an applicator 110 for applying the release agent 110 to the surface 30 of the drum 34. The DMU housing 104 is formed of a material, such as molded plastic, that is compatible with the release agent used in the device 10 and that is capable of withstanding the environment within the housing 11 of the printer 10 during operational use of the printer.

The reservoir 108 holds a supply of release agent 112 for application to the surface of the drum 34 by the applicator 110 of the DMU. The reservoir 104 may comprise a single holding area in the housing 104 that contains the release agent for the DMU 100 or multiple areas or compartments located in different locations within the housing 104. For example, the reservoir 108 may comprise a main receptacle 114 that holds a supply 112 of release agent for the DMU 100, an applicator receptacle 116 that holds release agent for saturating the applicator, and a sump 118. A pumping system 120 pumps release agent from the main receptacle 114 to the applicator receptacle 116 to saturate the applicator 110. The sump 118 is positioned to capture excess release agent delivered to the applicator receptacle 116 and release agent recovered from the drum 34, as well as dust, dried ink, and other debris diverted from the drum surface 30. The captured release agent is then filtered and returned to the main receptacle 114.

In the embodiment of FIG. 2A, the applicator 110 comprises a roller formed of an absorbent material, such as extruded polyurethane foam. In other embodiments, the applicator 110 may be provided in a number of other shapes, forms, and/or materials that enables release agent from the reservoir 108 to be applied to the surface 30 of the rotating member 34. The applicator 110 is rotatably supported in the housing 104 with a portion of the applicator 110 submerged in the release agent contained in the applicator receptacle. When the DMU housing 104 is positioned within the device 10, another portion of the applicator 110 contacts the surface 30 of the drum 34.

In operation, as the drum 34 rotates in direction 16, the roller 108 is driven to rotate in the direction of arrow 17 by frictional contact with the surface 30. As the roller 108 rotates, the point of contact between the roller 108 and the drum surface 30 continuously moves to enable a fresh portion of the roller 108 to continuously contact the drum surface 62 and apply the release agent. The DMU 100 is coupled to a positioning mechanism (not shown) that is configured to selectively move the applicator 110 with respect to the drum 34 so that the applicator 110 is moved into and out of contact with the surface 30.

A metering blade 122 may be incorporated into the DMU 100 to meter the release agent onto the surface 30 of the drum 34 to a desired thickness. The metering blade 122 is formed of an elastomeric material supported on an elongated metal support bracket 124 attached to the housing 104. The metering blade 122 is positioned to divert excess release agent from the surface 30 back to the applicator receptacle 116. A cleaning blade is also provided in the DMU 100 to scrape or wipe oil, dust, dried ink, and other contaminants from the surface 30 of the drum 34 and direct the oil and debris to the sump 118. The captured oil in sump 118 is filtered by a filter 128 positioned in the sump 118 in order to remove debris, such as paper dust, dried ink, and the like from the release agent prior to being returned to the main receptacle 114.

In the embodiment of FIGS. 1 and 2A, the DMU 100 is implemented as a customer replaceable unit (CRU). As used herein, a CRU is a self-contained, modular unit that enables all or most of the components of the CRU to be inserted into and removed from a printer as a functional self-contained unit. When implemented as a CRU, the components of the DMU, such as the housing 104, reservoir 108, release agent supply 112, and applicator 110 are configured in a modular form capable of being inserted into and removed from the housing 11 of the device 10 as single component. As depicted in FIG. 1, the device 10 includes a docking space or area 130 (shown schematically as a dotted line in FIG. 1) in the housing 11 for receiving the DMU 100. The device 10 and/or the DMU housing 104 may be provided with suitable attachment features (not shown), such as fastening mechanisms, latches, positioning guide features, and the like, to enable the correct placement of the DMU 100 within the housing 11.

As a CRU, the DMU 100 has an expected lifetime, or useful life, that corresponds to the amount of oil loaded in the DMU reservoir 108. When the supply of release agent in a DMU has been depleted, the DMU may be removed from its location or slot 130 in the device and replaced with another DMU. Referring again to FIG. 2A, the DMU 100 includes a memory device 132, such as an EEPROM, for storing operational values and other information pertaining to the DMU 100, such as the current mass or volume of release agent in the reservoir, the number of pages printed using the DMU 100, and other information that may be used to determine the current state of the DMU 100. The memory 132 may be implemented in a circuit board 134 or other structure. The circuit board 134 includes a suitable connecting structure 136 configured to releasably and electrically connect the circuit board 134 including memory 132 to the printer control system 68 when the DMU 100 is installed in the housing 11. Once the DMU 100 is inserted into the device 10 and the memory 132 is connected to the controller 70, the control system 68 may access the memory 132 to retrieve the operational values and may write to the memory 132 to update the values during use. In this manner, DMU performance and life expectancy may be tracked.

As mentioned above, positioning a fluid container, such as a DMU, within a housing of a printing device poses the risk of fluid leakage and spills onto the interior components of the printer. Leak detection systems that rely on conductive fluids are not suitable for detecting leaks in systems that use a non-conductive fluid, such as release agent. In addition, leak detection systems that utilize resistive sensing methods, float assemblies, or other complex detection methods may not be practical or cost effective to incorporate into customer replaceable DMUs.

Figure 2B:
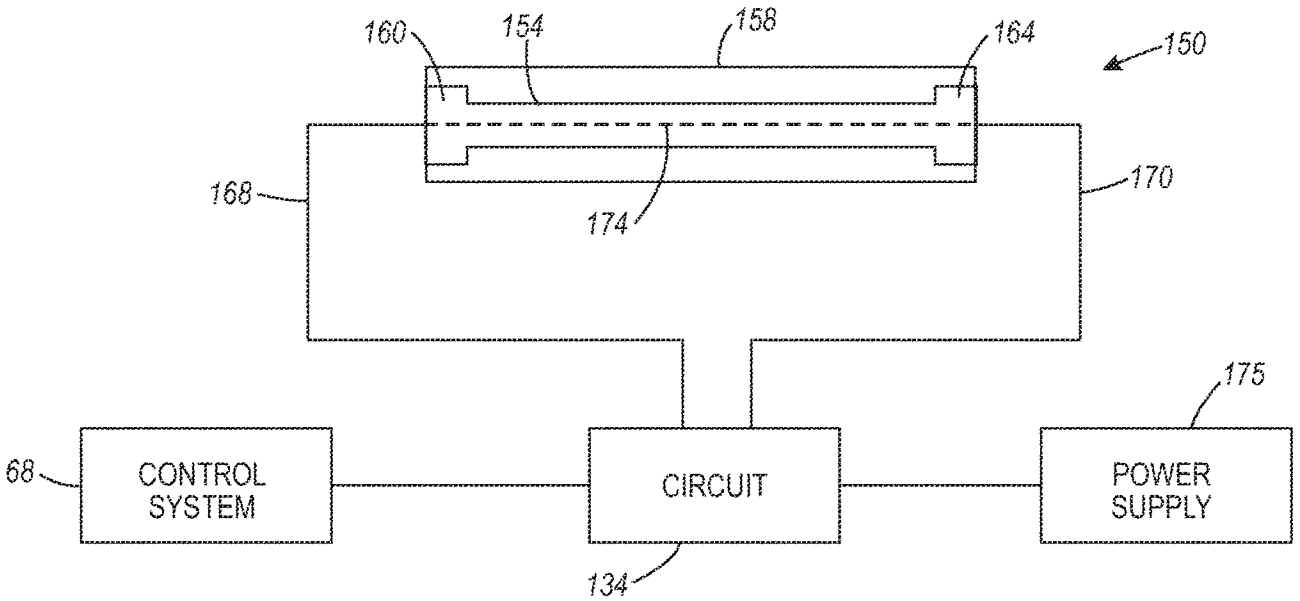
FIG. 2B is a schematic view of a release agent detector used in the drum maintenance system of FIG. 2A.

As an alternative to complex or costly leak detection systems, the DMU 100 includes at least one release agent detector 150 that may be incorporated into the DMU 100 during manufacturing or as an aftermarket component. Referring to FIG. 2B, a release agent detector 150 comprises an electrical conductor 154 supported by a substrate 158. As used herein, the term "substrate" used in relation to the release agent detector refers to a body formed of a material or combination of materials having a characteristic that changes or reacts in a predetermined manner in response to contact with release agent. For example, the substrate may be formed of a material or materials having an appearance, size, and/or shape that changes or reacts in response to contact with release agent by expanding, enlarging, swelling, shrinking, bending, dissolving, disintegrating, and the like. The term "electrical conductor" used in relation to the release agent detector refers to a conductive material, materials, or substance that defines a conductive path on the substrate, and that has a configuration that enables the change or reaction in the characteristic of the substrate to alter the electrical continuity of the conductive path in a predetermined manner. For example, the conductor may comprise a material applied to the substrate that is configured to break, split, or fracture when the substrate changes shape, size, swells, and/or dissolves, for example, when contacted by release agent. Alternatively, the conductor may comprise two or more conductors having an arrangement with respect to the substrate that allows the characteristic change or reaction of the substrate to open or close contact between the two or more conductors. Additional structures and/or mechanisms, such as biasing structures, may be utilized to facilitate engagement or disengagement of conductors when the substrate reacts to release agent.

The substrate 158 has an initial, stable form or state prior to being contacted by release agent. The initial form of the substrate 158 enables the substrate to be installed on or in the housing 104 of the DMU at appropriate locations for detecting leaks, spills, and other unwanted discharges of release agent from the reservoir. The substrate may be installed in the housing of the DMU in any suitable manner, such as by adhesives, fasteners, press-fit or snap-fit engagement, and the like. In one embodiment, for example, the substrate 158 may have a construction similar to a surface mount component or thick-film resistor to enable the substrate to be mounted directly onto the DMU housing. Alternatively, a separate mechanical support (not shown) may be provided for retaining the substrate and securing the substrate to the DMU housing.

Contact with release agent alters or changes one or more physical characteristics of the substrate 158 thereby transitioning the substrate from the initial state to a reaction state. As mentioned, the substrate may be formed of a material or materials having an appearance, size, and/or shape that changes or reacts in response to contact with release agent by expanding, enlarging, swelling, shrinking, bending, dissolving, or disintegrating. The reaction state may comprise the end state of the substrate resulting from contact with release agent as well as any or all intermediate changes, reactions, or states that occur during the transition from the initial state to the reaction state. Examples of materials that may be used in the substrate include silicon rubber and aluminum foil. Silicone rubber expands or swells through absorption when contacted by release agent. A conductive foil breaks or changes electrical conductivity in response to swelling of the silicone substrate in contact with the silicon oil release agent. A substrate may also comprise fluid soluble materials, including sugar and flour based wafers, that dissolve in response to contact with an aqueous or similar agent.

As depicted in FIG. 2B, the conductor 154 defines a conductive path 174 on the substrate 158 that extends between a first end 160 and a second end 164. The first end 160 is configured for connection to a first wiring connection 168, and the second end 164 is configured for connection to a second wiring connection 170. The first and second wiring connections electrically connect the conductor to a power supply 175. In the embodiment of FIG. 2B, the release agent detector is connected to the power supply via the circuit board 134. Power to the conductor 154 is established through circuit board 134 to the wiring connections 168, 170 when the DMU 100 is installed in the slot 118 of the printer. Alternatively, the wiring connections 168, 170 may be configured to connect directly to the printer control system 68 or another source of power when the DMU 100 is installed.

The conductor 154 is integrated into or onto the substrate 158 with an initial electrical continuity, also referred to herein as a first electrical continuity, on the conductive path 174 between the first wiring connection 168 and the second wiring connection. The conductor 154 may be installed with a first continuity that either closes or opens the circuit between the first wiring connection 168 and the second wiring connection 170 via the conductive path 174, similar to a normally-open or normally-closed switch. The initial or first continuity used for the conductor 154 depends on the type of reaction or change exhibited by the substrate in response to contact with release agent.

The conductor 154 and the substrate are arranged with respect to each other in a manner that enables the physical change or reaction of the substrate 158 to alter the electrical continuity of the conductor 154 from the initial, first continuity to a second continuity that is different than the first continuity. For example, the second continuity may comprise an interruption of an electrical connection between the first wiring connection 168 and the second wiring connection 170 established by the first continuity of the conductor 154. Alternatively, the second continuity may comprise an establishment of an electrical connection between the first wiring connection 168 and the second wiring connection 170 that was initially interrupted by the first continuity of the conductor 154.

In the embodiment of FIGS. 2A and 2B, the control system 68 is operatively connected to the conductor 154 via the wiring connections 168, 170 and is configured to monitor the electric current in the conductor 154 to detect a change from the first continuity of the conductor 154 to the second continuity indicative of the substrate 158 contacting release agent. Any suitable method of monitoring current or electrical continuity of the conductor 154 may be implemented by the control system 68. In response to detecting these changes, the control system 68 may take the appropriate action, such as initiating a user recognizable alarm, reporting an error condition, disabling the DMU pumping system, and/or disabling printer operations. In an alternative embodiment, the DMU 100 may be provided with a separate control system (not shown) for monitoring the electrical characteristics of the conductor and providing indications to the printer control system 68 when release agent leak conditions are occurring.

Figure 3A:
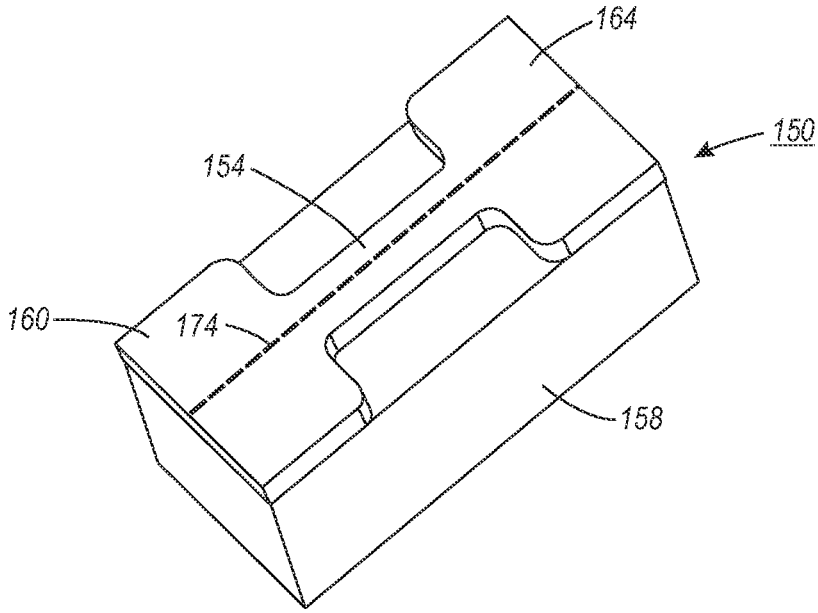
FIG. 3A is a perspective view of an embodiment of a release agent detector in an initial state prior to contact with release agent.
Figure 3B:
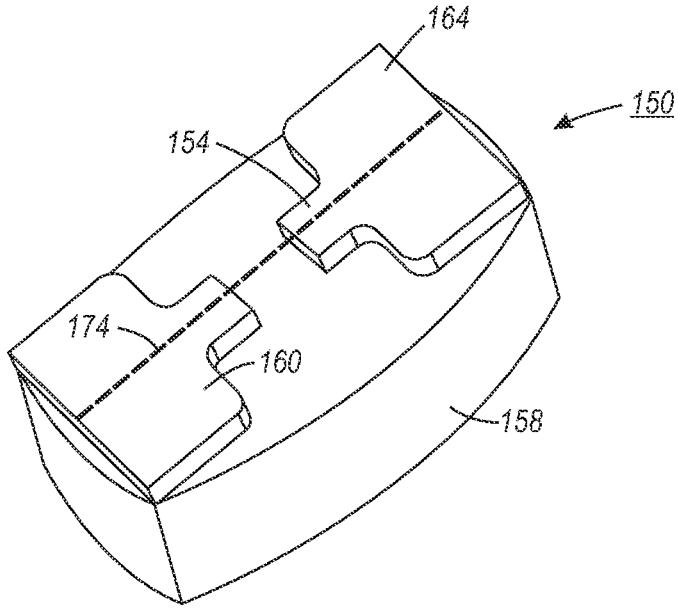
FIG. 3B is a perspective view of the release agent detector of FIG. 3A after being contact with release agent.

FIGS. 3A and 3B depict one embodiment of a release agent detector 150 that includes a substrate 158 formed of a material, such as silicone rubber, that expands or swells when contacted by release agent. FIG. 3A shows the substrate 158 in an initial unexpanded state prior to contact with release agent. As seen in FIG. 3A, the conductor 154 is placed on the substrate 158 with a first continuity that establishes an electrical connection on the conductive path between the first end and the second end. The ends 160, 164 of the conductor 154 are flared out in this example to allow for easy attachment to the wiring connections 168, 170 (FIG. 2), or to a mechanical retainer (not shown) that functions as an electrical connector.

Until contacted by release agent, the substrate 158 and conductor 154 remain substantially as depicted in FIG. 3A with a first continuity between the wiring connections 168, 170 (FIG. 2). When contacted by release agent, the substrate 154 changes state from the initial state to a reaction state and alters the continuity of the conductor 154 from the first continuity to a second continuity in which the electrical connection between the wiring connections 168, 170 is interrupted. The conductor 154 in the embodiment of FIGS. 3A and 3B is formed of a conductive material with a limited ability to expand or change shape. For example, the electrical conductor 154 may comprise a conductive paint or coating material that is painted, silkscreened, sprayed, printed, or otherwise adhered in some way to the substrate. When the substrate 158 is contacted by release agent and swells or expands as depicted in FIG. 3B, the conductor 154 breaks at one or more places along the conductive path 174, and the electrical continuity of the conductive path 174 is interrupted. The interruption of the continuity provides an indication of a release agent leak condition to the control system 68. In some embodiments, the release agent detector 150 as depicted in FIGS. 3A and 3B may be operatively connected to a power circuit of the DMU 100 so that it may also be used as a fail-safe mechanism to interrupt power to the DMU or a component of the DMU, such as the pumping system 120.

Figure 4A:
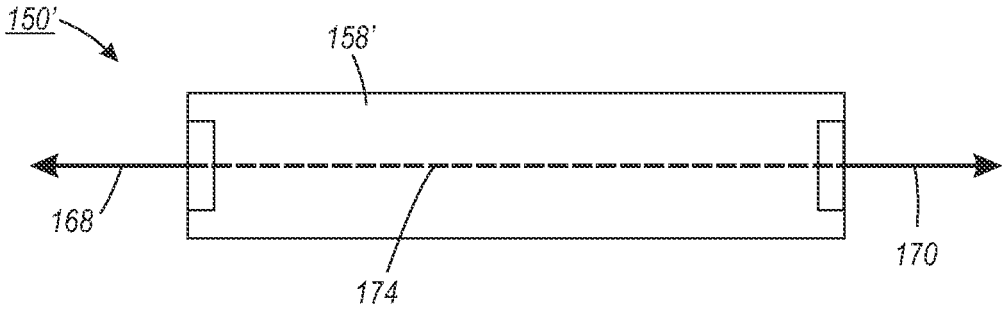
FIG. 4A is a perspective view of another embodiment of a release agent detector in an initial state prior to contact with release agent.
Figure 4B:
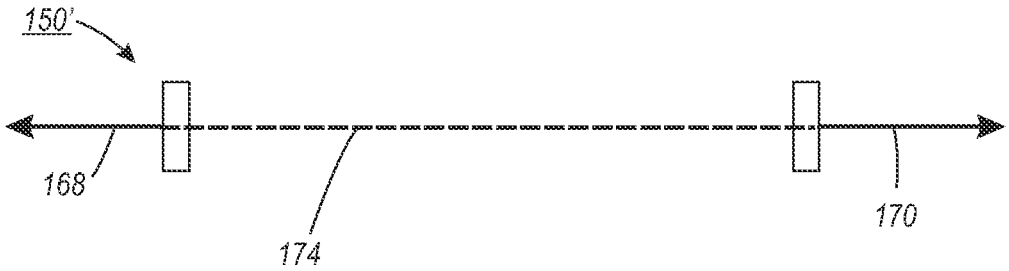
FIG. 4B is a perspective view of the release agent detector of FIG. 4A after being contacted with release agent.

FIGS. 4A and 4B depict an embodiment of a release agent detector 150' including a substrate 158' formed at least partially of a material that dissolves when contacted with release agent. In this embodiment, the electrical continuity of the conductor is interrupted when the substrate dissolves. In FIGS. 4A and 4B, the substrate 158' may be formed at least partially of a conductive material, such as aluminum foil, to serve as the conductor. The conductive substrate material is installed with a first continuity that establishes an electrical connection between the wiring connections 168, 170. As depicted in FIG. 4A, the conductive substrate 158' maintains continuity of the conductive path 174 prior to contact with release agent. When contacted with release agent, the conductive substrate 158' dissolves as depicted in FIG. 4B and interrupts the continuity of the conductive path 174, thus transitioning from the first continuity to the second continuity and providing an indication of a leak condition. As an alternative to the use of a conductive material for the substrate 158' in the embodiment of FIGS. 4A and 4B, a water soluble material, such as a sugar or flour based wafer painted with a conductive paint or coating, may be used to the same effect.

Figure 5A:
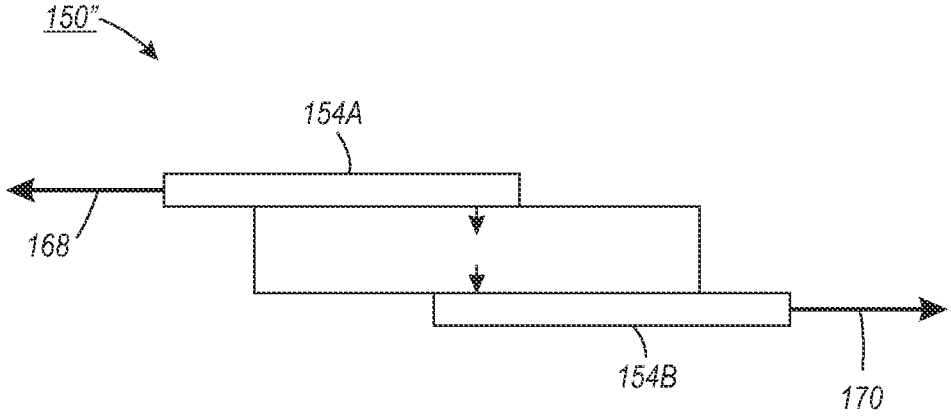
FIG. 5A is a perspective view of yet another embodiment of a release agent detector in an initial state prior to contact with release agent.
Figure 5B:
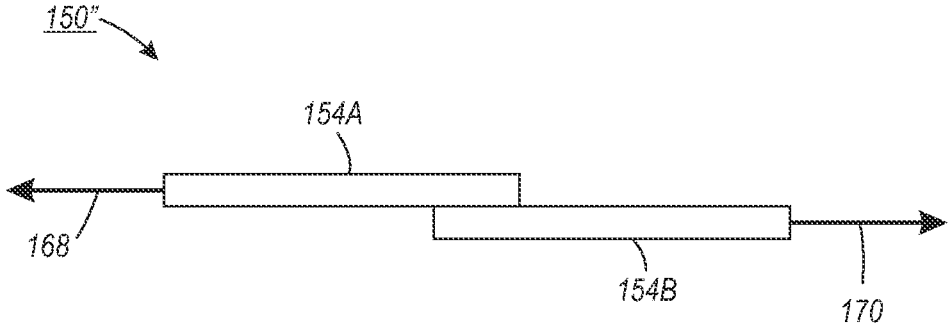
FIG. 5B is a perspective view of the release agent detector of FIG. 5A after being contacted with release agent.

The release agent detectors of FIGS. 3A, 3B, 4A, and 4B are operable to interrupt the electrical continuity of a circuit. FIGS. 5A and 5B depict an embodiment of a release agent detector 150" that is configured to establish electrical continuity of a circuit. In FIGS. 5A and 5B, the conductor 154 includes a first conductor **154*a* and a second conductor 154*b*. The first conductor 154*a* is operatively connected to the first wiring connection 168, and the second conductor 154*b* is operatively connected to the second wiring connection 170. As depicted in FIG. 5A, the first conductor 154*a* and second conductor 154*b* are separated by a substrate 158" so that the first continuity of the conductive path is interrupted. The substrate responds to contact with release agent by altering the continuity from the first continuity to a second continuity that establishes an electrical connection between the wiring connections 168, 170. For example, in this embodiment, the substrate 158" is formed of a soluble non-conductive material, such as a sugar or flour based wafer, which dissolves when contacted with release agent. When the substrate 158" dissolves as depicted in FIG. 5B, the first conductor 154***a* and the second conductor 154*b* contact each other and establish electrical continuity for the conductive path. A mechanical bias mechanism (not shown) may be provided to bias the first conductor and the second conductor toward contact with each other although not necessarily.

The embodiments of release agent detectors described above are configured to operate generally as a switch that transitions the continuity of the conductive path from the first continuity to the second continuity substantially immediately in response to contact with release agent. In alternative embodiments, release agent detectors may have a configuration that enables a gradual change in the electrical continuity of the conductive path in response to contact with release agent. A gradual change in the electrical conductivity of a detector provides time to alert an operator of the printer prior to the complete breakdown of the detector.

Figure 6:
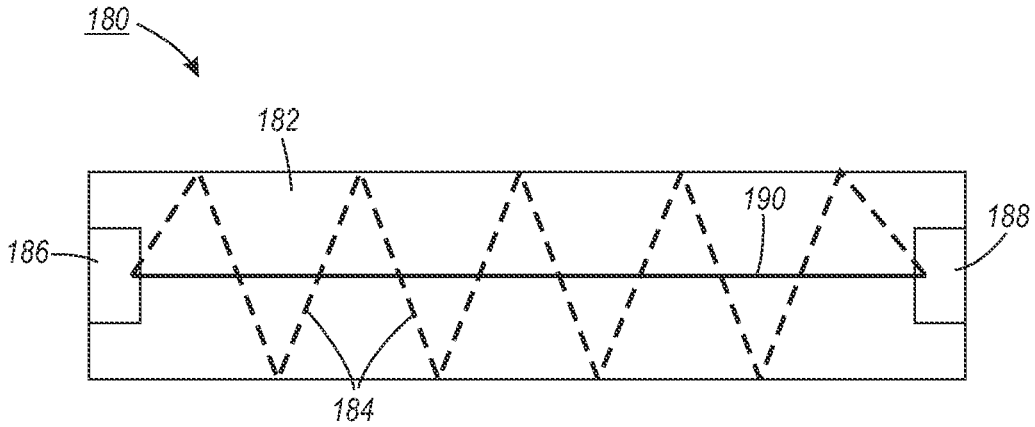
FIG. 6 is a perspective view of another embodiment of a release agent detector in an initial state prior to contact with release agent.

FIG. 6 depicts an embodiment of a release agent detector that enables a gradual change in conductivity. The detector 180 of FIG. 6 includes a substrate 182, a first conductor 184, and a second conductor 190. In this embodiment, the substrate comprises a material, such as silicone rubber, that expands or swells when contacted by release agent. The first conductor 188 defines a zig-zag shaped path between the ends 186, 188 of the substrate. The second conductor 190 defines a more direct path, e.g., a substantially straight line, between the ends 186, 188 that intersects the segments of the first conductor 184. When the substrate begins to fail, i.e., expand, in response to contact with release agent, the shorter paths of the second conductor 190 break which increases the resistance of the detector prior to the failure. In another embodiment, a gradual change in conductivity for a detector may be implemented by using a conductive material, such as carbon or sputtered metal, in combination with a dissolvable binder material, such as sugar or flour. As the binder material begins to dissolve in response to contact with the fluid being detected, the conductive material in the binder is dispersed thereby changing the resistance of the detector.

It will be appreciated that variations of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A printer comprising:

a rotatable member having an image receiving surface;

a printing system configured to deposit ink onto the surface of the rotatable member;

a supply of release agent, the release agent supply including an applicator that is configured for selective engagement with the rotating image receiving member to transfer release agent from the release agent supply to the rotating image receiving member;

a release agent detector positioned proximate the release agent supply, the release agent detector including an electrical conductor and a substrate, the substrate responds to contact with release agent to alter electrical continuity of the electrical conductor;

an electrical power supply operatively connected to the electrical conductor of the release agent detector; and a controller operatively connected to the electrical conductor of the release agent to monitor electrical current in the electrical conductor of the release agent detector and to detect a change in the electrical continuity of the electrical conductor occurring in response to the substrate contacting release agent.

2. The printer of claim 1 wherein the electrical conductor is mounted on the substrate and the substrate swells in response to contact with release agent to interrupt the electrical continuity of the electrical conductor.

3. The printer of claim 1 wherein the electrical conductor is mounted on the substrate and the substrate dissolves in response to contact with release agent to interrupt the electrical continuity of the electrical conductor.

4. The printer of claim 1, the electrical conductor further comprising:

a first electrical conductor; and a second electrical conductor, the substrate being positioned between the first electrical conductor and the second electrical conductor to isolate electrically the first electrical conductor from the second electrical conductor, the substrate being comprised of a material that dissolves in response to contact with release agent to establish electrical continuity between the first electrical conductor and the second electrical conductor.

5. The printer of claim 1 wherein the substrate comprises a conductive foil.

6. The printer of claim 1 wherein the substrate is made of silicone rubber and the electrical conductor is a layer of conductive paint applied to the silicone rubber.

7. A release agent detector for use in a solid ink printer comprising:

an electrical conductor; and a substrate, the substrate being configured to respond to contact with release agent to interrupt electrical continuity of the electrical conductor.

8. The release agent detector of claim 7 wherein the electrical conductor is mounted on the substrate and the substrate swells in response to contact with release agent to interrupt electrical continuity of the electrical conductor.

9. The release agent detector of claim 7 wherein the electrical conductor is mounted on the substrate and the substrate dissolves in response to contact with release agent to interrupt electrical continuity of the electrical conductor.

10. The release agent detector of claim 7, the electrical conductor further comprising:

a first electrical conductor; and a second electrical conductor, the substrate being positioned between the first electrical conductor and the second electrical conductor to isolate electrically the first electrical conductor from the second electrical conductor, the substrate being comprised of a material that dissolves in response to contact with release agent to establish electrical continuity between the first electrical conductor and the second electrical conductor.

11. The release agent detector of claim 7 wherein the substrate comprises aluminum foil.

12. The printer of claim 7 wherein the substrate is made of silicone rubber and the electrical conductor is a layer of conductive paint applied to the silicone rubber.

13. A method of detecting release agent leaks in a solid ink printer comprising:

positioning a substrate proximate an electrical conductor;

operatively connecting an electrical current to the electrical conductor; and detecting an interruption in the electrical current that occurs in response to the substrate contacting release agent.

14. The method of claim 13, the electrical current interruption detection further comprising:

detecting the interruption in the electrical current flowing through the electrical conductor in response to the substrate swelling as release agent contacts the substrate.

15. The method of claim 13, the electrical current interruption detection further comprising:

detecting the interruption in the electrical current flowing through the electrical conductor in response to the substrate dissolving as release agent contacts the substrate.

16. The method of claim 13, the positioning of the substrate further comprising:

interposing the substrate between a first electrical conductor and a second electrical conductor to electrically isolate the first electrical conductor from the second electrical conductor; and the electrical current interruption detection further comprising:

detecting commencement of a flow of electrical current through the first electrical conductor and the second electrical conductor in response to release agent contacting the substrate and the substrate dissolving to establish electrical continuity between the first electrical conductor and the second electrical conductor.

17. The method of claim 13, the positioning of the substrate further comprising:

mounting the electrical conductor on an aluminum foil substrate.

18. The method of claim 13, the positioning of the substrate further comprising:

applying a layer of conductive paint to a silicone rubber substrate.

19. A drum maintenance unit for an inkjet printer, the drum maintenance unit comprising:

a housing configured for insertion into and removal from an inkjet printer proximate a rotatable image receiving member in the inkjet printer, the housing including a reservoir;

a supply of release agent contained within the reservoir;

an applicator supported by the housing, the applicator being configured for selective engagement with the rotatable member to transfer release agent from the release agent supply to the rotatable member;

a release agent detector secured to the housing proximate the release agent supply, the release agent detector including an electrical conductor and a substrate, the substrate responds to contact with release agent to alter electrical continuity of the electrical conductor; and an electrical connector configured to electrically couple the conductor of the release agent detector to a power supply when the housing is inserted into the solid ink printer.

20. The drum maintenance unit of claim 19, wherein the electrical connector is further configured to operatively connect the electrical conductor to a controller, the controller being configured to monitor electrical current in the electrical conductor of the release agent detector and to detect a change in the electrical continuity of the electrical conductor occurring in response to the substrate contacting release agent.

21. The drum maintenance unit of claim 19 wherein the electrical conductor is mounted on the substrate and the substrate swells in response to contact with release agent to interrupt the electrical continuity of the electrical conductor.

22. The drum maintenance unit of claim 19 wherein the electrical conductor is mounted on the substrate and the substrate dissolves in response to contact with release agent to interrupt the electrical continuity of the electrical conductor.

23. The drum maintenance unit of claim 19, the electrical conductor further comprising:

a first electrical conductor; and a second electrical conductor, the substrate is positioned between the first electrical conductor and the second electrical conductor to isolate electrically the first electrical conductor from the second electrical conductor, the substrate being comprised of a material that dissolves in response to contact with release agent to establish electrical continuity between the first electrical conductor and the second electrical conductor.

24. The drum maintenance unit of claim 19 wherein the substrate is an aluminum foil.

25. The drum maintenance unit of claim 19 wherein the substrate is made of silicone rubber and the electrical conductor is a layer of conductive paint applied to the silicone rubber.

26. A method of servicing an inkjet printer comprising:

removing a first drum maintenance unit from an inkjet printer, the first drum maintenance unit including a reservoir for containing a supply of release agent, an applicator for transferring release agent from the reservoir to a surface of a rotatable image receiving member of the inkjet printer, and a first release agent detector including a first electrical conductor having a first electrical continuity; and installing a second drum maintenance unit in the inkjet printer, the second drum maintenance unit including a reservoir for containing a supply of release agent, an applicator for transferring release agent from the reservoir to the surface of the rotatable image receiving member, and a second release agent detector having a second electrical conductor and a substrate, the second electrical conductor having a second electrical continuity, the substrate being comprised of a material that changes in response to contact with release agent, wherein the second electrical conductor and the substrate are configured in the second drum maintenance unit to enable the second electrical conductor to change from the second electrical continuity to the first electrical continuity in response to the substrate contacting release agent.

27. A method of servicing a drum maintenance unit, the method comprising:

removing a first release agent detector from a housing of a drum maintenance unit, the housing including a reservoir for containing a supply of release agent and an applicator for transferring release agent from the reservoir to a rotatable image receiving surface of an inkjet printer, the first release agent detector having a first electrical conductor, the first electrical conductor having a first electrical continuity; and incorporating a second release agent detector into the housing of the drum maintenance unit, the second release agent detector having a second electrical conductor and a substrate, the second electrical conductor having a second electrical continuity, the second being comprised of a material that alters the electrical continuity of the second electrical conductor from the second electrical continuity to the first electrical continuity in response to contact with release agent.

28. The method of claim 27, the removal of the first release agent detector further comprising:

removing the housing of the drum maintenance unit from the inkjet printer before the second release agent detector is incorporated into the housing.

29. The method of claim 27 further comprising:

inserting the housing of the drum maintenance unit into the inkjet printer after the second release agent detector is incorporated into the housing.

* * * * *